US010524032B1

(12) United States Patent
Gu

(10) Patent No.: US 10,524,032 B1
(45) Date of Patent: Dec. 31, 2019

(54) SPEAKER BOX

(71) Applicant: AAC Technologies Pte. Ltd., Singapore (SG)

(72) Inventor: Xiaojiang Gu, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/524,185

(22) Filed: Jul. 29, 2019

(30) Foreign Application Priority Data

Aug. 1, 2018 (CN) ..... 2018 2 1237334 U

(51) Int. Cl.
*H04R 1/02* (2006.01)
*H04R 9/02* (2006.01)

(52) U.S. Cl.
CPC ..... *H04R 1/021* (2013.01); *H04R 9/025* (2013.01); *H04R 2499/11* (2013.01)

(58) Field of Classification Search
CPC ..... H04R 1/02; H04R 1/025; H04R 1/403; H04R 9/025; H04R 2499/11; H04R 5/02; H04R 2205/021; H04R 17/00; H04R 17/005; H04R 15/00; H04R 7/045
USPC ..... 381/332, 190, 396, 400, 412, 420
See application file for complete search history.

(56) References Cited

U.S. PATENT DOCUMENTS 10,250,729 B1 * 4/2019 Jeon ..... H04B 1/38
2007/0081692 A1 * 4/2007 Chiba ..... H04R 9/022 381/398
2012/0155696 A1 * 6/2012 Zhang ..... H04R 9/06 381/412
2014/0119592 A1 * 5/2014 Choi ..... H04R 9/025 381/412
2014/0294225 A1 * 10/2014 Ji ..... H04R 1/023 381/386
2016/0241938 A1 * 8/2016 Huang ..... H04R 1/023

* cited by examiner

*Primary Examiner* — Ahmad F. Matar
*Assistant Examiner* — Sabrina Diaz
(74) *Attorney, Agent, or Firm* — W&G Law Group LLP

(57) ABSTRACT

The present invention provides a sound generator, including: a vibration system including a diaphragm and a voice coil; a frame with an accommodation space, including an upper surface, a lower surface, and an inner wall; and a magnetic circuit system including a magnetic yoke and a side plate bending and extending from the bottom plate. The side plate is fixed on the inner wall, the bottom plate covers the lower surface and encloses the accommodation space. The lower surface obliquely extends in a direction close to the upper surface and forms an extension surface. The extension surface extends to an edge of the frame, one end of the extension close to the edge of the bottom plate is spaced apart from the bottom plate for forming a leakage channel communicating with the accommodation space and an outside of the speaker box.

10 Claims, 2 Drawing Sheets

SPEAKER BOX

FIELD OF THE PRESENT DISCLOSURE

The embodiments of the invention relate to the electroacoustic components, in particular to a speaker box used in a portable device.

DESCRIPTION OF RELATED ART

With the arrival of mobile internet era, the number of intelligent mobile devices is on the increase. While among so many mobile devices, mobile phone is undoubtedly the most common and portable mobile device. Currently, mobile phone has a great variety of functions including but not limited to high-quality music function, and a loudspeaker in the mobile phone is one of the necessary conditions for achieving such high-quality music function.

A speaker box usually includes a frame, a vibration system accommodated in the frame and a magnetic circuit system driving the vibration system to vibrate. To adjust the atmospheric pressure inside the speaker box, a leaking hole is usually provided at the bottom of the frame. The bottom face of the frame of the prior art is usually a planar structure, so foreign substances tend to enter inside of the speaker box from the leaking hole, thus influencing the reliability of the product.

Therefore, it is necessary to provide an improved speaker box to solve the problem above.

BRIEF DESCRIPTION OF THE DRAWINGS

Many aspects of the exemplary embodiment can be better understood with reference to the following drawings. The components in the drawing are not necessarily drawn to scale, the emphasis instead being placed upon clearly illustrating the principles of the present disclosure.

DETAILED DESCRIPTION OF THE EXEMPLARY EMBODIMENT

The present disclosure will hereinafter be described in detail with reference to exemplary embodiment. To make the technical problems to be solved, technical solutions and beneficial effects of the present disclosure more apparent, the present disclosure is described in further detail together with the figures and the embodiment. It should be understood the specific embodiment described hereby are only to explain the disclosure, not intended to limit the disclosure.

Figure 1:
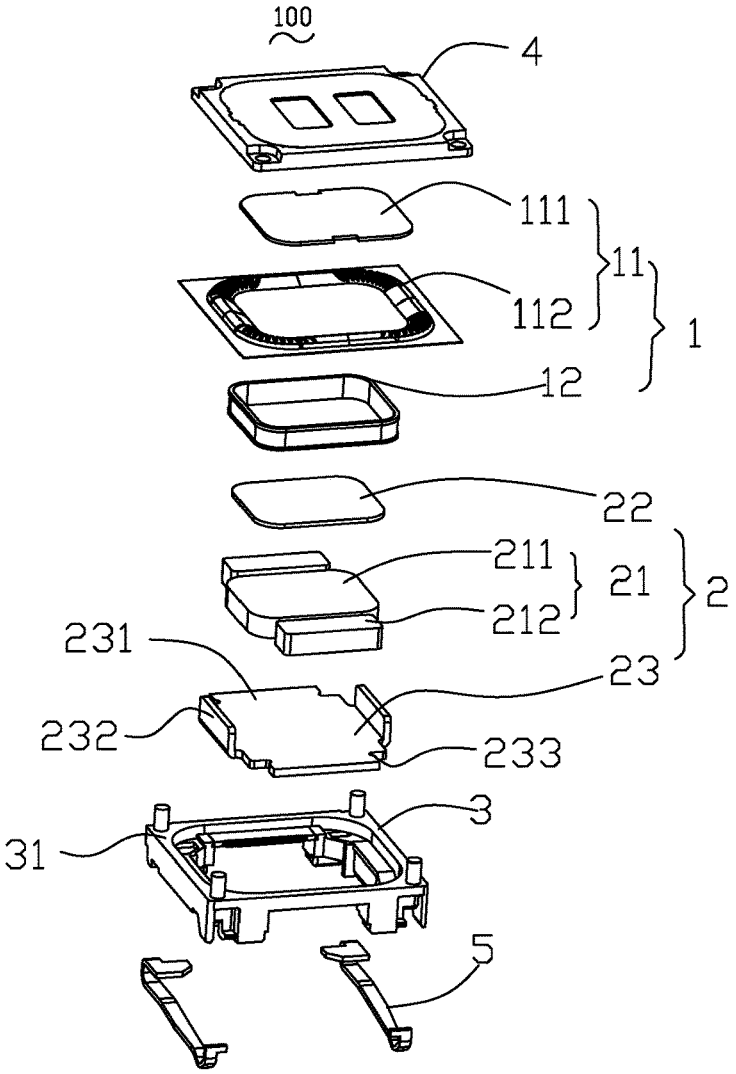
FIG. 1 is an exploded view of a speaker box in accordance with an exemplary embodiment of the invention.
Figure 2:
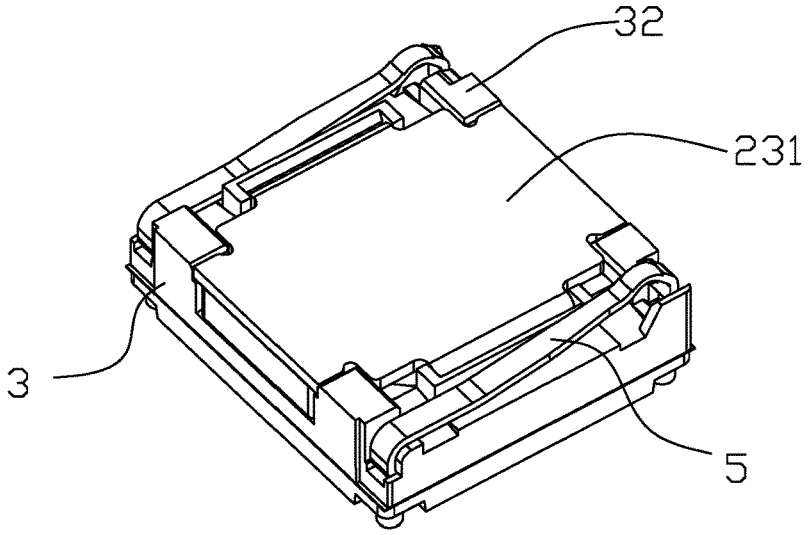
FIG. 2 an assembled view of the speaker box in FIG. 1.

As shown in FIGS. 1-2, a speaker box 100 is provided by the present invention. The speaker box includes a vibration system 1, a magnetic system 2, a frame 3 accommodating and fixing the vibration system 1 and the magnetic system 2.

The vibration system 1 includes a diaphragm 11 and a voice coil 12 driving the diaphragm 11 to vibrate. The voice coil 12 is formed by wrapping conductive wires. The diaphragm 11 includes a dome 112 and an annular suspension 111 surrounding the dome 112. Specifically in this embodiment, the dome 112 and the suspension 111 are a two-piece structure, and the dome 112 is attached to a top of the suspension 111. Optionally, in alternative embodiments, the dome can also be provided at the bottom of the suspension, or the dome and the suspension can be an integrated structure, which are all applicable.

The frame 3 is a frame structure with an inner accommodation space, and includes an upper surface 31, a lower surface 32 opposite to the upper surface 31, and an inner wall 33 connecting the upper surface 31 and the lower surface 32 and enclosing to form the accommodating space. The diaphragm 11 is fixed on the upper surface 31 of the frame 3, specifically, the edge of the side of the suspension 111 far away from the dome 112 is fixed on the upper surface 31. Further, the speaker box also includes an upper cover 4 matched with the frame 3, and the upper cover 4 is provided on the upper surface 31. The diaphragm 11 is sandwiched between the upper cover 4 and the frame 3.

The magnetic circuit system 2 includes a magnet 21, a pole plate 22 attached onto the magnet 21, and a magnetic yoke 23 accommodating the magnet 21 and the pole plate 22. The magnet 21 includes a main magnet 211 provided at a center of the magnetic yoke 23 and auxiliary magnets 212 provided on both sides of the main magnet 211. In this embodiment, the main magnet 211 is a rectangular permanent magnet, the auxiliary magnets 212 are long-bar shaped magnets provided on both sides along the two long axes of the main magnet 211. A magnetic gap is formed between the main magnet 211 and the auxiliary magnets 212, and the voice coil 12 is inserted into the magnetic gap for interacting with the magnetic fluxes produced in the magnetic gap while electrified, for driving the diaphragm 11 to vibrate along a vibration direction. Needless to say, the structure of the magnet 21 is not limited to what is mentioned, in other alternative embodiments, the auxiliary magnet can also be provided in other number or structure or even not provided, all of which are applicable. The pole plate 22 is made of magnetic conductive material and attached to the surface of the main magnet 211 far away from the magnetic yoke, for magnetic induction, magnetic field convergence to improve the magnetic inductive capacity of the products. The magnetic yoke 23 includes a bottom plate 231 and a side plate 232 bending and extending from the bottom plate 231.

Figure 3:
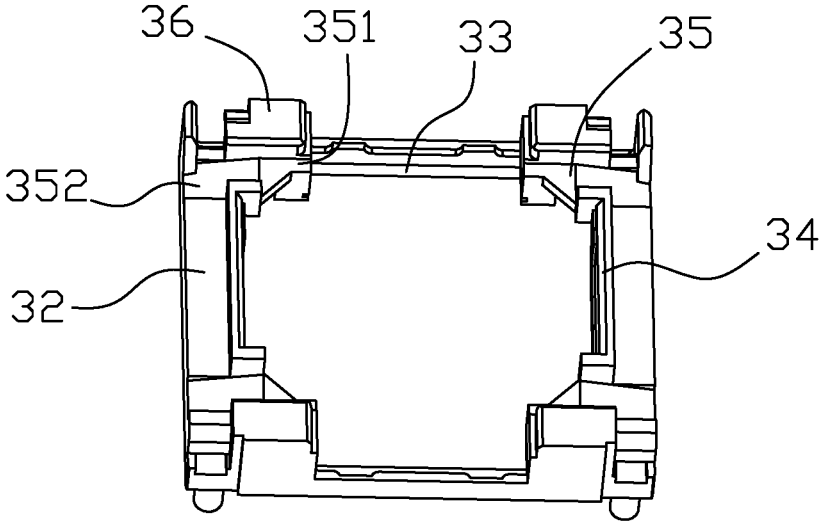
FIG. 3 is an isometric view of a frame of the sound generator.
Figure 4:
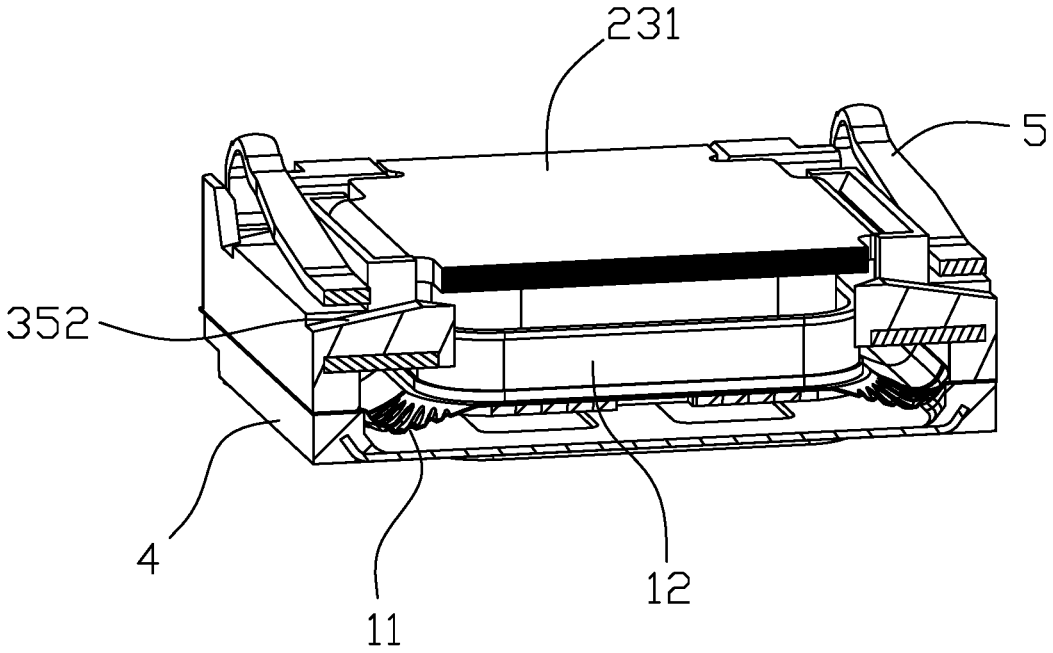
FIG. 4 is a cross-sectional view of the speaker box.

With reference to FIGS. 3-4, a fixing groove 34 for fixing the side plate 232 is provided in the inner wall 33 of the frame 3. The side plate 232 of the magnetic yoke 23 is fixed inside the fixing groove 34, and the bottom plate 231 is provided as a cover on the lower surface 32 of the frame 3, thereby enclosing the accommodation space to separate the accommodation space from the outside. The bottom plate 231 is a long-bar structure. Two side plates 232 are located at the central location on the sides of the two long axes of the bottom plate 231 respectively. Correspondingly, two fixing grooves 34 are also provided respectively at the central location at the inner wall 33 in the long-axis direction of the frame 3. Optionally, in other alternative embodiments, four side plates 232 can also be provided.

The lower surface 32 of the frame 3 corresponding to an edge of the bottom plate 231 extends obliquely in a direction toward the upper surface 31 to form an extension surface 35. The extension surface 35 extends to the edge of the frame 3, and one end of the edge of the extension surface 35 close to the bottom plate 231 is disposed spaced apart from the bottom plate 231 and forms a leakage channel connecting the accommodation space and the outside. The leakage channel is provided corresponding separately to four corners of the bottom plate 231. The extension surface 35 includes a leakage plane 351 parallel to the bottom plate 231 and spaced apart from the bottom plate 231, and a leakage bevel 352 extending from one side of the leakage plane 351 far away from the accommodation space to the edge of the frame in the direction towards the upper surface. Preferably, in this embodiment, the bottom plate 231 completely covers the leakage plane 351, and the leakage bevel 352 extends obliquely upwards from the edge of the leakage plane 351 to the edge of the frame. Therefore, not only leakage is formed between the leakage plane 351 and the bottom plate 231, but also the foreign substances which fall near the leakage channel will move to the edge of the frame 3 along the leakage bevel 352 under gravity, thus avoiding the foreign substances entering into the speaker box through the leakage channel to affect the reliability of the product. In this embodiment, four extension surfaces 35 are provided, respectively corresponding to the four corners of bottom plate 231, needless to say, in other alternative embodiments, it's also applicable that only one leakage channel is formed at one of the corners.

Further, the frame 3 further includes a support part 36 protruding and extending from the lower surface 32, an avoidance part 233 is also provided at the four corners of the bottom plate 231 for avoiding the support part 36, the bottom plate 231 is abutted onto the support part 36 through the avoidance part 233. Therefore, it can achieve a tighter combination of the frame 3 and the magnetic yoke 23, thus improving the reliability of the product.

A conductive terminal 5 is also provided inside the frame 3. The conductive terminal 5 is injection molded integrally inside the frame 3, thus achieving electrical connection between the speaker box and an external circuit.

The speaker box of the present invention includes a frame with accommodation space, a magnetic circuit system and a vibration system accommodated in the frame. The vibration system includes the diaphragm and voice coil driving the diaphragm to vibrate. The magnetic circuit system includes a magnetic yoke and a magnet carried by the magnetic yoke. The magnetic yoke includes a bottom plate provided opposite to the diaphragm and a side plate bending and extending from the bottom plate to the diaphragm. The frame includes an upper surface close to the diaphragm, a lower surface corresponding to the upper surface, and an inner wall connecting the upper surface and the lower surface and enclose to form an accommodation space. The side plate is fixed on the inner wall, and the bottom plate covers the lower surface and encloses the accommodation space. The lower surface corresponding to the edge of the bottom plate obliquely extends in the direction close to the upper surface and forms an extension surface extending to the edge of the frame. One end of the extension close to the edge of the bottom plate is provided spaced apart from the bottom plate, and forms a leakage channel communicating with the accommodation space and the outside. The speaker box forms an extension surface on the frame, which tilts in the direction towards the upper surface, so a foreign substance dropping onto the lower surface of the speaker box can easily slide out along the extension surface instead of entering into the speaker box through the leakage channel, thus improving reliability of the product.

It is to be understood, however, that even though numerous characteristics and advantages of the present exemplary embodiment have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A speaker box, including;

a vibration system including a diaphragm and a voice coil for driving the diaphragm to vibrate;

a frame with an accommodation space, including an upper surface close to the diaphragm, a lower surface corresponding to the upper surface, and an inner wall connecting the upper surface and the lower surface for enclosing to form the accommodation space;

a magnetic circuit system including a magnetic yoke having a bottom plate opposite to the diaphragm and a side plate bending and extending from the bottom plate toward the diaphragm and a magnet carried by the magnetic yoke; wherein the side plate is fixed on the inner wall, the bottom plate covers the lower surface and encloses the accommodation space, the lower surface corresponding to an edge of the bottom plate obliquely extends in a direction close to the upper surface and forms an extension surface; and wherein the extension surface extends to an edge of the frame, one end of the extension surface close to the edge of the bottom plate is spaced apart from the bottom plate for forming a leakage channel communicating with the accommodation space and an outside of the speaker box.

2. The speaker box as described in claim 1, wherein one end of the extension surface close to the bottom plate extends towards the inside of the accommodation space and forms a leakage plane parallel to and spaced apart from the bottom plate.

3. The speaker box as described in claim 1, wherein the bottom plate is a long-bar structure, the side plate is provided at a center at the edge of the bottom plate.

4. The speaker box as described in claim 3, wherein two side plates are provided on the sides of two long axes of the bottom plate.

5. The speaker box as described in claim 3, wherein the leakage channel is provided respectively corresponding to the four corners of the bottom plate.

6. The speaker box as described in claim 1, wherein a fixing groove for fixing the side plate is provided on the inner wall.

7. The speaker box as described in claim 1, wherein the frame comprises a support part protruding and extending from the lower surface, an avoidance part for avoiding the support part is provided at four corners of the bottom plate, and the bottom plate abuts against the support part through the avoidance part.

8. The speaker box as described in claim 1, wherein the magnetic circuit system further comprises a pole plate attached to one side surface of the magnet far away from the bottom plate.

9. The speaker box as described in claim 1 further comprising an upper cover engaging with the frame, wherein the diaphragm is sandwiched and fixed between the upper cover and the frame.

10. The speaker box as described in claim 1 further comprising a conductive terminal injection molded inside the frame and electrically connected with the voice coil.

* * * * *